US007775791B2

(12) United States Patent
Swanson et al.

(10) Patent No.: US 7,775,791 B2
(45) Date of Patent: Aug. 17, 2010

(54) METHOD AND APPARATUS FOR STAGED COMBUSTION OF AIR AND FUEL

(75) Inventors: Larry William Swanson, Laguna Hills, CA (US); Roy Payne, Mission Viejo, CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/036,772

(22) Filed: Feb. 25, 2008

(65) Prior Publication Data

US 2009/0214989 A1 Aug. 27, 2009

(51) Int. Cl.
*F23C 7/00* (2006.01)

(52) U.S. Cl. ..... 431/187; 110/104 B; 110/260; 110/261; 110/263; 110/265

(58) Field of Classification Search ..... 431/187; 110/104 B, 260, 261, 263, 265
See application file for complete search history.

(56) References Cited

U.S. PATENT DOCUMENTS 1,457,522 A * 6/1923 Grindle ..... 110/104 B
1,995,934 A * 3/1935 Mangold ..... 239/416.5
2,961,000 A * 11/1960 Remus et al. ..... 137/599.17
3,139,138 A * 6/1964 Bloom ..... 431/177
3,202,201 A 8/1965 Masella et al.
3,214,284 A * 10/1965 Wilson ..... 106/437
3,308,869 A * 3/1967 Livingston ..... 431/187
3,689,041 A * 9/1972 Pere et al. ..... 432/12
3,706,520 A * 12/1972 Grimm et al. ..... 431/10
3,729,285 A * 4/1973 Schwedersky ..... 431/8
3,743,606 A * 7/1973 Marion et al. ..... 252/373
3,788,065 A * 1/1974 Markowski ..... 60/773
3,788,796 A * 1/1974 Krippene et al. ..... 431/2
3,792,582 A * 2/1974 Markowski ..... 60/737
3,811,277 A * 5/1974 Markowski ..... 60/733
3,847,564 A * 11/1974 Marion et al. ..... 48/95
3,951,584 A * 4/1976 Thekdi ..... 431/352
4,023,921 A * 5/1977 Anson ..... 431/9
4,067,682 A * 1/1978 Lado ..... 431/11
4,252,300 A * 2/1981 Herder ..... 266/144

(Continued)

FOREIGN PATENT DOCUMENTS

EP 0965649 A1 12/1999

(Continued)

OTHER PUBLICATIONS

Intellectual Property Office, Foreign Search Report related to Application No. GB0902241.9 dated Jun. 12, 2009.

(Continued)

*Primary Examiner*—Kenneth B Rinehart
*Assistant Examiner*—Jorge Pereiro
(74) *Attorney, Agent, or Firm*—Armstrong Teasdale LLP

(57) ABSTRACT

A method for operating a fuel-fired furnace including at least one burner is provided. The method includes channeling a first fluid flow to the at least one burner at a first predetermined velocity, and channeling a second fluid flow to the at least one burner at a second predetermined velocity during a first mode of operation of the at least one burner. The second predetermined velocity is different than the first predetermined velocity.

16 Claims, 3 Drawing Sheets

U.S. PATENT DOCUMENTS 4,309,165 A * 1/1982 McElroy ..... 431/8
4,422,389 A * 12/1983 Schroder ..... 110/264
4,428,727 A * 1/1984 Deussner et al. ..... 431/182
4,455,949 A * 6/1984 Kretschmer et al. ..... 110/263
4,479,442 A 10/1984 Itse et al.
4,505,665 A * 3/1985 Mansour ..... 431/10
4,539,918 A 9/1985 Beer et al.
4,626,195 A * 12/1986 Sato et al. ..... 431/188
4,845,940 A * 7/1989 Beer ..... 60/732
4,915,619 A * 4/1990 LaRue ..... 431/284
4,931,013 A * 6/1990 Brahmbhatt et al. ..... 431/10
4,952,136 A * 8/1990 Collins et al. ..... 431/183
4,976,607 A * 12/1990 Grimard ..... 431/174
5,116,584 A 5/1992 Chen et al.
5,118,481 A 6/1992 Lyon
5,178,533 A * 1/1993 Collenbusch ..... 431/8
5,217,363 A * 6/1993 Brais et al. ..... 431/186
5,261,602 A * 11/1993 Brent et al. ..... 239/132.3
5,263,849 A 11/1993 Irwin et al.
5,270,025 A 12/1993 Ho et al.
5,315,939 A 5/1994 Rini et al.
5,329,866 A 7/1994 LaRue
5,411,394 A * 5/1995 Beer et al. ..... 431/9
5,488,916 A 2/1996 Bozzuto
5,626,085 A 5/1997 Donais et al.
5,694,869 A 12/1997 Breen et al.
5,727,480 A 3/1998 Garcia-Mallol
5,743,723 A * 4/1998 Iatrides et al. ..... 431/8
5,756,059 A 5/1998 Zamansky et al.
5,799,594 A 9/1998 Dernjatin et al.
5,878,676 A 3/1999 Jochem et al.
5,904,475 A * 5/1999 Ding ..... 431/8
5,957,678 A * 9/1999 Endoh et al. ..... 431/5
5,975,886 A * 11/1999 Philippe ..... 431/165
6,058,855 A 5/2000 Ake et al.
6,074,197 A * 6/2000 Philippe ..... 431/10
6,085,674 A 7/2000 Ashworth
6,092,362 A * 7/2000 Nagafuchi et al. ..... 60/39.281
6,126,438 A * 10/2000 Joshi et al. ..... 431/161
6,145,297 A * 11/2000 Nagafuchi et al. ..... 60/39.281
6,189,464 B1 2/2001 Okazaki et al.
6,190,158 B1 * 2/2001 Legiret et al. ..... 431/8
6,191,451 B1 2/2001 Nowak et al.
6,237,513 B1 5/2001 Tobiasz et al.
6,244,860 B1 * 6/2001 Gross et al. ..... 432/219
6,258,336 B1 7/2001 Breen et al.
6,280,695 B1 8/2001 Lissianski et al.
6,298,796 B1 10/2001 Okazaki et al.
6,318,277 B1 11/2001 Kokkinos
6,325,002 B1 12/2001 Ashworth
6,325,003 B1 12/2001 Ashworth et al.
6,325,618 B1 * 12/2001 Benz et al. ..... 431/187
6,331,107 B1 * 12/2001 Philippe ..... 431/285
6,345,505 B1 * 2/2002 Green ..... 60/748
6,352,680 B1 * 3/2002 Watson et al. ..... 423/573.1
6,360,677 B1 * 3/2002 Robillard et al. ..... 110/260
6,453,830 B1 9/2002 Zauderer
6,471,506 B1 10/2002 Zamansky et al.
6,497,187 B2 12/2002 Khinkis et al.
6,506,357 B2 * 1/2003 Watson et al. ..... 423/573.1
6,599,118 B2 7/2003 Pisupati
6,682,339 B2 * 1/2004 Cho ..... 431/8
6,694,900 B2 2/2004 Lissianski et al.
6,699,030 B2 3/2004 Bool, III et al.
6,699,031 B2 * 3/2004 Kobayashi et al. ..... 431/10
6,702,571 B2 * 3/2004 Abbasi et al. ..... 431/187
6,752,620 B2 * 6/2004 Heier et al. ..... 431/8
6,790,030 B2 9/2004 Fischer et al.
6,865,994 B2 3/2005 Seeker et al.
6,932,958 B2 * 8/2005 Wangerow et al. ..... 423/652
7,004,086 B2 2/2006 Morrison et al.
7,014,458 B2 * 3/2006 Marin et al. ..... 431/10
7,028,622 B2 * 4/2006 Taylor ..... 110/265
7,047,891 B2 5/2006 Vatsky
RE39,425 E * 12/2006 Taylor ..... 431/350
7,244,119 B2 7/2007 Chung et al.
7,523,603 B2 * 4/2009 Hagen et al. ..... 60/39.55
2001/0003577 A1 * 6/2001 Watson et al. ..... 423/576.8
2001/0039813 A1 * 11/2001 Simpson et al. ..... 65/134.4
2002/0028415 A1 * 3/2002 Cho ..... 431/187
2002/0064742 A1 * 5/2002 Ligasacchi et al. ..... 431/190
2003/0054301 A1 3/2003 Borders et al.
2003/0104328 A1 * 6/2003 Kobayashi et al. ..... 431/10
2003/0108833 A1 6/2003 Kobayashi et al.
2003/0143502 A1 7/2003 Heier et al.
2004/0009446 A1 * 1/2004 Tsiava et al. ..... 431/187
2004/0185401 A1 9/2004 Moberg
2004/0185402 A1 9/2004 Moberg
2006/0000395 A1 * 1/2006 Joshi et al. ..... 110/267
2006/0230996 A1 * 10/2006 Kaczenski et al. ..... 110/341
2007/0079736 A1 4/2007 Okazaki
2007/0092847 A1 4/2007 Okazaki et al.
2007/0172781 A1 7/2007 Tsiava et al.
2008/0020334 A1 * 1/2008 Joshi et al. ..... 431/2
2008/0250990 A1 * 10/2008 Jia et al. ..... 110/347
2009/0047199 A1 * 2/2009 Arrol et al. ..... 423/210
2009/0084294 A1 * 4/2009 Sarv ..... 110/345
2009/0084346 A1 * 4/2009 Zhou et al. ..... 123/276

FOREIGN PATENT DOCUMENTS

EP 1016825 A1 7/2000
GB 2043871 A 10/1980
JP 59195018 A 11/1984
JP 2005024136 A 1/2005
WO 8902051 A1 3/1989
WO 9908045 2/1999
WO 03044434 A1 5/2003
WO 2005118113 A1 12/2005

OTHER PUBLICATIONS

Intellectual Property Office, Foreign Search Report related to Application No. GB0902241.9 dated Sep. 9, 2009.

* cited by examiner

METHOD AND APPARATUS FOR STAGED COMBUSTION OF AIR AND FUEL

BACKGROUND OF THE INVENTION

This invention relates generally to combustion devices and, more particularly, to a multi-function burner for use with combustion devices.

During a typical combustion process within a furnace or boiler, for example, a flow of combustion gas, or flue gas, is produced. Known combustion gases contain combustion products including, but not limited to, carbon, fly ash, carbon dioxide, carbon monoxide, water, hydrogen, nitrogen, sulfur, chlorine, and/or mercury generated as a result of combusting solid and/or liquid fuels.

At least some known furnaces use air/fuel staged combustion, such as a three-stage combustion, to facilitate reducing the production of at least some of the combustion products, such as nitrogen oxide (NOx). A three-stage combustion process includes combusting fuel and air in a first stage, introducing fuel into the combustion gases in a second stage, and then introducing air into the combustion gases in a third stage. In the second stage, fuel is injected, without combustion air, to form a sub-stoichiometric, or fuel-rich, zone. During the second stage, at least some of the fuels combust to produce hydrocarbon fragments that react with NOx that may have been produced in the first stage. As such, the NOx may be reduced to atmospheric nitrogen in the second stage. In the third stage, air is injected to consume the carbon monoxide and unburnt hydrocarbons exiting the second stage. Although such air/fuel staging may achieve relatively high NOx reduction, the use of injectors that are dedicated to either air injection or fuel/air combustion may limit the operation of the furnace and may limit the flexibility in staging air and/or fuel.

BRIEF DESCRIPTION OF THE INVENTION

In one aspect, a method for operating a fuel-fired furnace including at least one burner is provided. The method includes channeling a first fluid flow to the at least one burner at a first predetermined velocity, and channeling a second fluid flow to the at least one burner at a second predetermined velocity during a first mode of operation of the at least one burner. The second predetermined velocity is different than the first predetermined velocity.

In another aspect a burner for use with a fuel-fired furnace is provided. The burner includes a first duct configured to channel a fuel flow into the furnace, and a second duct substantially concentrically-aligned with and extending through the first duct. The second duct is configured to channel a first fluid flow into the furnace, wherein the first fluid flow is a non-fuel flow.

In a still further aspect a fuel-fired furnace coupled to a fuel source and an air source is provided. The furnace includes a combustion zone defined within the furnace, and a plurality of burners coupled within the combustion zone. At least one of the plurality of burners includes a first duct coupled to the fuel source via a first flow regulation device. The furnace also includes a second duct extending through the first duct, wherein the second duct is coupled to the air source via a second flow regulation device. The first flow regulation device and the second flow regulation device are selectively operable based on an operation of the furnace.

DETAILED DESCRIPTION OF THE INVENTION

Figure 1:
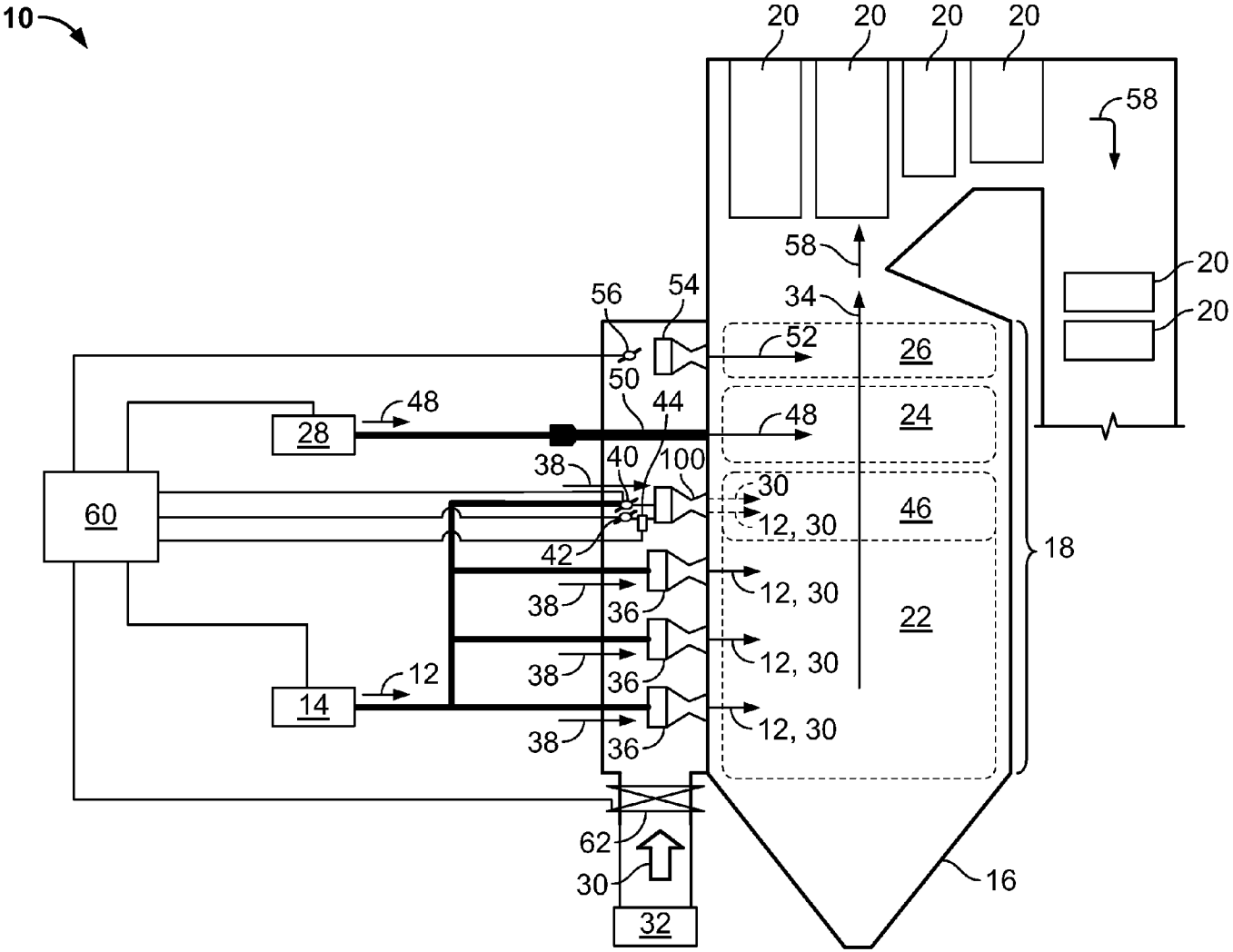
FIG. 1 is a schematic view of an exemplary power plant system.

FIG. 1 is a schematic view of an exemplary power plant system 10. In the exemplary embodiment, system 10 is supplied with fuel 12 in the form of coal. Alternatively, fuel 12 may be any other suitable fuel, such as, but not limited to, oil, natural gas, biomass, waste, or any other fossil or renewable fuel. In the exemplary embodiment, fuel 12 is supplied to system 10 from a main fuel source 14 to a boiler or a furnace 16. More specifically, in the exemplary embodiment, system 10 includes a fuel-fired furnace 16 that includes a combustion zone 18 and heat exchangers 20. More specifically, combustion zone 18 includes a primary combustion zone 22, a reburning zone 24, and a burnout zone 26. Alternatively, combustion zone 18 may not include reburning zone 24 and/or burnout zone 26, in which case, furnace 16 is a "straight fire" furnace (not shown). Fuel 12 enters system 10 through fuel sources 14 and 28, as described in more detail below, and air 30 enters system 10 through an air source 32. Alternatively, fuel 12 may enter system 10 from other than fuel sources 14 and 28. The fuel/air mixture is ignited in primary combustion zone 22 to create combustion gas 34.

In the exemplary embodiment, fuel 12 and air 30 are supplied to primary combustion zone 22 through one or more main injectors and/or burners 36. In the exemplary embodiment, burners 36 are low-NOx burners. Main burners 36 receive a predetermined amount of fuel 12 from fuel source 14 and a predetermined quantity of air 30 from air source 32. Burners 36 may be tangentially arranged in each corner of furnace 16, wall-fired, or have any other suitable arrangement that enables furnace 16 to function as described herein. In the exemplary embodiment, burners 36 are oriented within furnace 16 such that a plurality of rows 38 of burners 36 are defined. Although only one burner 36 is illustrated in each row 38, each row 38 may include a plurality of burners 36.

In the exemplary embodiment, at least one burner 36 is a multi-function burner 100. Alternatively, combustion zone 18 may include a row 38 and/or array (not shown) of multi-function burners 100. Moreover, although multi-function burner 100 is shown as being in the row 38 that is the most downstream, multi-function burner may be included anywhere within combustion zone 18 that enables system 10 to function as described herein. In the exemplary embodiment, multi-function burner 100 either burns the fuel/air mixture 12 and 30 or injects air 30 into combustion zone 18. Moreover, in the exemplary embodiment, multi-function burner 100 is coupled in flow communication with main fuel source 14 and air source 32. At least one fuel flow regulation device 40 is coupled between multi-function burner 100 and main fuel source 14, and at least one air flow regulation device 42 is coupled between multi-function burner 100 and air source 32. In the exemplary embodiment, an air velocity control device 44 is coupled between multi-function burner 100 and air source 32 to facilitate controlling the velocity of at least a portion of the air 30 discharged through multi-function burner 100. Furthermore, in the exemplary embodiment, air flow regulation device 42 is coupled upstream from velocity control device 44 such that regulation device 42 controls an amount of air 30 entering velocity control device 44.

In the exemplary embodiment, an intermediate air zone 46 is defined proximate multi-function burner 100 within primary combustion zone 22. Alternatively, intermediate air zone 46 may be defined downstream from, and/or upstream from, primary combustion zone 22. In the exemplary embodiment, intermediate air zone 46 is an air staging zone when multi-function burner 100 is used for air injection, and intermediate air zone 46 forms a portion of primary combustion zone 22 when multi-function burner 100 is used similarly to burners 36.

Combustion gases 34 flow from primary combustion zone 22 and/or intermediate air zone 46 towards reburning zone 24. In reburning zone 24, a predetermined amount of reburn fuel 48 is injected through a reburn fuel inlet 50. Reburn fuel 48 is supplied to inlet 50 from a reburn fuel source 28. Although reburn fuel 48 and fuel 12 are shown as originating at a different sources 14 and 28, reburn fuel 48 may be supplied from the same source (not shown) as fuel 12. In one embodiment reburn fuel 48 is a different type of fuel than fuel 12. For example, fuel 12 entering from main fuel source 14 may be, but is not limited to being, pulverized coal, and reburn fuel 48 entering from reburn fuel source 28 may be natural gas. Alternatively, any suitable combination of fuel 12 and/or 48 that enables system 10 to function as described herein may be injected into furnace 16. In the exemplary embodiment, the amount of reburn fuel 48 injected is based on achieving a desired stoichiometric ratio within reburning zone 24. More specifically, in the exemplary embodiment, an amount of reburn fuel 48 is injected to create a fuel-rich environment in reburning zone 24.

Combustion gases 34 flow from reburning zone 24 into burnout zone 26. In the exemplary embodiment, overfire air 52 is injected into burnout zone 26 through an overfire air inlet 54, and a predetermined quantity of overfire air 52 is injected into burnout zone 26. In the exemplary embodiment, overfire air inlet 54 is in flow communication with air source 32 via an overfire air regulation device 56. Alternatively, overfire air 52 may be supplied to system 10 through a source (not shown) that is separate from air source 32. The quantity of overfire air 52 supplied is selected based on achieving a desired stoichiometric ratio within burnout zone 26. More specifically, in the exemplary embodiment, the quantity of overfire air 52 supplied is selected to facilitate completing combustion of fuel 12 and reburn fuel 48, which facilitates reducing pollutants in combustion gas 34, such as, but not limited to, nitrogen oxides, $NO_x$, and/or carbon monoxide, CO.

In the exemplary embodiment, flue gases 58 exit combustion zone 18 and enter heat exchangers 20. Heat exchangers 20 transfer heat from flue gas 58 to a fluid (not shown) in a known manner. More specifically, the heat transfer heats the fluid, such as, for example, heating water to generate steam. The heated fluid, for example, the steam, is used to generate power, typically by known power generation methods and systems (not shown), such as, for example, a steam turbine (not shown). Alternatively, heat exchangers 20 transfer heat from flue gas 58 to a fuel cell (not shown) used to generate power. Power may be supplied to a power grid (not shown) or any other suitable power outlet.

In the exemplary embodiment, system 10 includes a control system 60 that is operatively coupled at least to a main air regulation device 62, main fuel source 14, reburn fuel source 28, overfire air regulation device 56, air velocity control device 44, air flow regulation device 42, and fuel flow regulation device 40. Control system 60 facilitates controlling sources 14 and 28 and devices 40, 42, 44, 56, and 62 to adjust the stoichiometric ratios within combustion zone 18 by activating and/or deactivating air and fuel flows from sources 14 and 28 and/or through devices 40, 42, 44, 56, and 62. More specifically, main air regulation device 62 is used to regulate the air 30 entering burners 36, multi-function burner 100, and/or overfire air inlet 54, main fuel source 14 is used to enable fuel 12 to enter system 10, reburn fuel source 28 is used to enable reburn fuel 48 to enter system 10, overfire air regulation device 56 regulates the amount of overfire air 52 entering system 10 from air source 32 through overfire inlet 54, air flow regulation device 42 and air velocity control device 44 each regulate the amount and/or velocity of air 30 entering system 10 through multi-function burner 100, and fuel flow regulation device 40 is used to enable fuel 12 to enter system 10 through multi-function burner 100.

During operation of system 10, fuel 12, air 30, reburn fuel 48, and/or overfire air 52 are injected and combusted in combustion zone 18 to form flue gases 58 that flow from combustion zone 18 through heat exchangers 20. More specifically, in the exemplary embodiment, control system 60 controls air and fuel entering combustion zone 18 to form flue gases 58. Furthermore, in the exemplary embodiment, control system 60 causes multi-function burner 100 either to inject air 30 into combustion zone 18, or to burn fuel 12 and air 30 in primary combustion zone 22. More specifically, in the exemplary embodiment, when multi-function burner 100 is used to burn fuel 12 and air 30, control system 60 causes fuel flow regulation device 40 to inject fuel 12 into combustion zone 18 through multi-function burner 100, causes main air regulation device 62 to inject air 30 into combustion zone 18 through multi-function burner 100, and causes air flow regulation device 42 to prevent air 30 from being injected into combustion zone 18 through multi-function burner 100. As such, fuel 12 and air 30 are entering combustion zone 18 through multi-function burner 100 from fuel flow regulation device 40 and main air regulation device 62, respectively, to facilitate the combustion of fuel 12 in air 30.

Furthermore, in the exemplary embodiment, when multi-function burner 100 is used to inject air 30, control system 60 controls fuel flow regulation device 40 to prevent fuel 12 from entering combustion zone 18 through multi-function burner 100, controls main air regulation device 62 to inject air 30 into combustion zone 18 through multi-function burner 100 at a first velocity $V_1$, and controls air flow regulation device 42 and air velocity control device 44 to inject air 30 into combustion zone 18 through multi-function burner 100 at a second velocity $V_2$. In the exemplary embodiment, velocity $V_2$ is higher than velocity $V_1$. As such, air 30 enters combustion zone 18 through multi-function burner 100 from air flow regulation device 42 and main air regulation device 62 such that a first portion 202 (shown in FIGS. 2 and 3) of air 30 is at velocity $V_1$ and a second portion 204 (shown in FIGS. 2 and 3) of air 30 is at velocity $V_2$. In another embodiment, air 30 entering through air flow regulation device 42 is not accelerated through air velocity control device 44, such that air 30 entering combustion zone 18 through multi-function burner 100 is supplied from air flow regulation device 42 and main air regulation device 62 at substantially the same velocity.

Control system 60 further controls the stoichiometric ratio within combustion zone 18. For example, when multi-function burner 100 is used to inject air 30, main fuel source 14 and/or main air regulation device 62 are controlled such that a first stoichiometric ratio $SR_{1A}$ within primary combustion zone 22 is fuel rich, air velocity control device 44 and air flow regulation device 42 are controlled such that a second stoichiometric ratio $SR_{2A}$ within intermediate air zone 46 is less fuel rich than stoichiometric ratio $SR_{1A}$, reburn fuel source 28 is controlled such that a third stoichiometric ratio $SR_{3A}$ within reburning zone 24 is more fuel rich than stoichiometric ratio $SR_{2A}$, and overfire air regulation device 56 is controlled such that a forth stoichiometric ratio $SR_{4A}$ within burnout zone 26 is approximately an ideal stoichiometric ratio. Alternatively, stoichiometric ratios $SR_{1A}$, $SR_{2A}$, $SR_{3A}$, and/or $SR_{4A}$ may have any values and/or relative values that enable system 10 to function as described herein.

In another example, when multi-function burner 100 is used to combust fuel 12 and air 30, and when multi-function burner 100 is considered to be within the primary combustion zone 22 such that intermediate air zone 46 is not implemented, main fuel source 14, fuel flow regulation device 40, and main air regulation device 62 are controlled to ensure that a first stoichiometric ratio $SR_{1B}$ within primary combustion zone 22 is fuel lean, reburn fuel source 28 is controlled to ensure that a third stoichiometric ratio $SR_{3B}$ within reburning zone 24 is fuel rich, and overfire air regulation device 56 is controlled to ensure that a forth stoichiometric ratio $SR_{4B}$ within burnout zone 26 is approximately an ideal stoichiometric ratio. Alternatively, stoichiometric ratios $SR_{1B}$, $SR_{3B}$, and/or $SR_{4B}$ may have any values and/or relative values that enable system 10 to function as described herein.

In the exemplary embodiment, flue gases 58 exiting combustion zone 18 enter heat exchangers 20 to transfer heat to fluid for use in generating power. Within primary combustion zone 22, fuel products not entrained in combustion gas 34 may be solids (not shown) and may be discharged from furnace 16 as waste (not shown).

Figure 2:
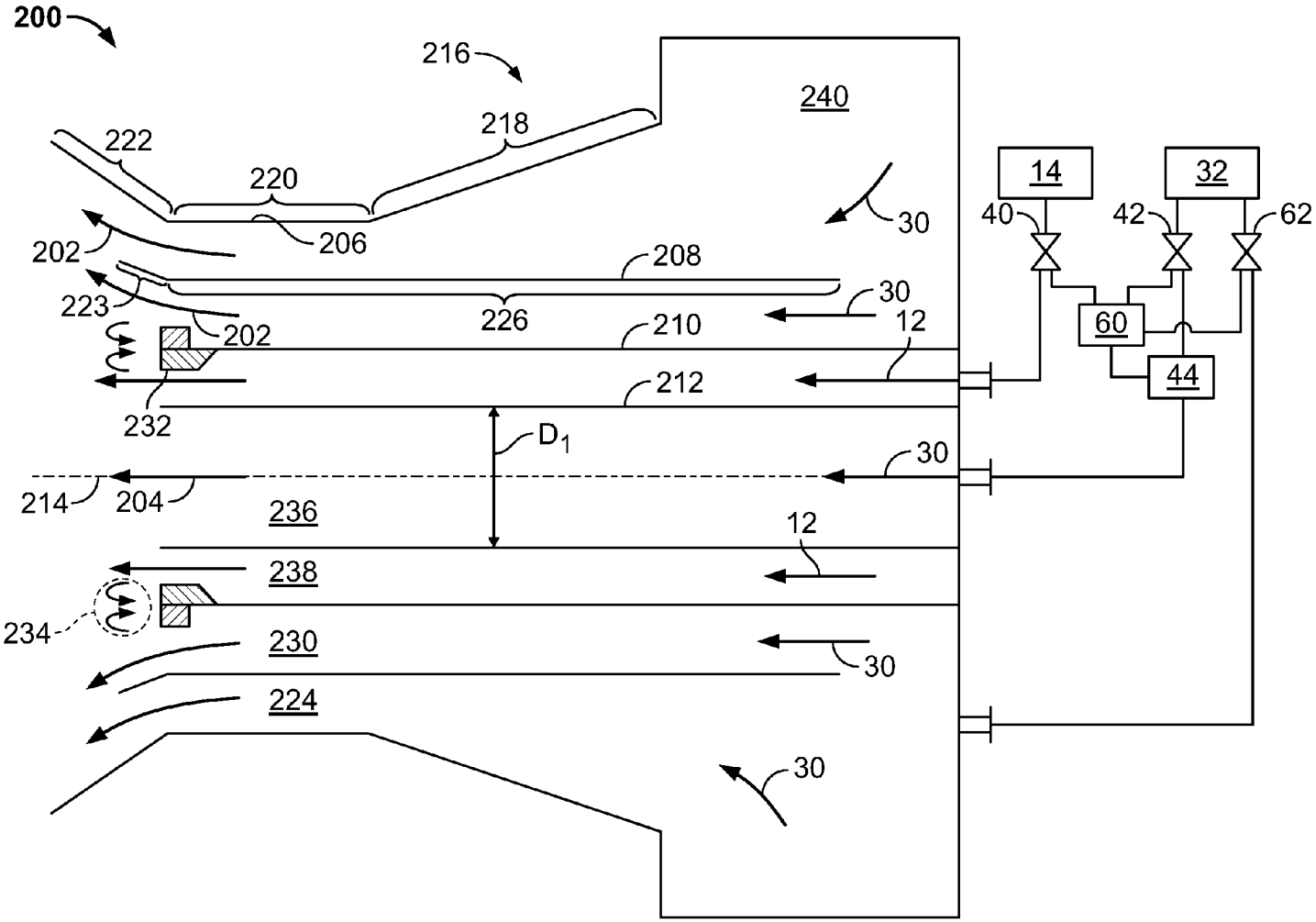
FIG. 2 is a schematic view of an exemplary burner that may be used with the power plant system shown in FIG. 1.

FIG. 2 is a schematic view of an exemplary multi-function burner 200 that may be used as burner 100 within system 10 (shown in FIG. 1). In the exemplary embodiment, burner 200 has a substantially circular cross-sectional shape (not shown). Alternatively, burner 200 may have any suitable cross-sectional shape that enables burner 200 to function as described herein.

In the exemplary embodiment, multi-function burner 200 includes a first duct 206, a second duct 208, a third duct 210, and a fourth duct 212 that are each substantially concentrically aligned with a centerline 214 of the burner 200. More specifically, first duct 206 is the radially outermost of the ducts 206, 208, 210, and 212 such that a radially outer surface 216 of first duct 206 defines the outer surface of burner 200. Furthermore, in the exemplary embodiment, first duct 206 includes a convergent and substantially conical section 218, a substantially cylindrical section 220, and a divergent and substantially conical section 222. Second duct 208, in the exemplary embodiment, is spaced radially inward from first duct 206 such that a first passageway 224 is defined between first and second ducts 206 and 208. Moreover, second duct 208 includes a substantially cylindrical section 226 and a divergent and substantially conical section 228.

In the exemplary embodiment, third duct 210 is spaced radially inward from second duct 208 such that a second passageway 230 is defined between second and third ducts 208 and 210. Furthermore, in the exemplary embodiment, third duct 210 is substantially cylindrical and includes an annular flame regulation device 232, such as a flame holder, that creates a recirculation zone 234. Fourth duct 212, in the exemplary embodiment, defines a center passageway 236 that has a diameter $D_1$ and that is radially spaced inward from third duct 210 such that a third passageway 238 is defined between third and fourth ducts 210 and 212. In the exemplary embodiment, fourth duct 212 is substantially cylindrical including having conical and/or cylindrical shapes, ducts 206, 208, 210, and 212 may each have any suitable configuration or shape that enables burner 200 to function as described herein.

First and second ducts 206 and 208, in the exemplary embodiment, are each coupled in flow communication with a common plenum 240, which is coupled in flow communication with air source 32 via main air regulation device 62. Alternatively, first and second ducts 206 and 208 are each coupled separately in flow communication independently with air source 32 such that first and second ducts 206 and 208 do not share a common plenum 240. In the exemplary embodiment, first and second ducts 206 and 208 are oriented such that air 30 may be injected into common plenum 240, through first passageway 224 and/or second passageway 230, and into primary combustion zone 22 (shown in FIG. 1) and/or intermediate air zone 46 (shown in FIG. 1). In one embodiment, first passageway 224 and/or second passageway 230 may induce a swirl flow pattern (not shown) to air 30 injected through first passageway 224 and/or second passageway 230.

Furthermore, third duct 210, in the exemplary embodiment, is coupled in flow communication with fuel source 14 via fuel flow regulation device 40. In the exemplary embodiment, third duct 210 is oriented such that fuel 12 may be injected through third passageway 238 and into primary combustion zone 22, when burner 200 is used to combust fuel 12 and air 30. Moreover, fourth duct 212, in the exemplary embodiment, is coupled in flow communication with air source 32 via air flow regulation device 42 and air velocity control device 44. In the exemplary embodiment, fourth duct 212 is oriented such that air 30 may be injected through center passageway 236 and into intermediate air zone 46 at a predetermined velocity, when burner 200 is used to inject air 30.

During a first operation of multi-function burner 200, burner 200 is used to burn fuel 12 and air 30. Control system 60 controls fuel flow regulation device 40 to enable fuel 12 to enter combustion zone 18 through third passageway 238, controls main air regulation device 62 to inject air 30 into combustion zone 18 through first passageway 224 and/or second passageway 230, and controls air flow regulation device 42 to prevent air 30 from being injected into combustion zone 18 through center passageway 236.

During a second operation of multi-function burner 200, burner 200 is used to inject air 30. Control system 60 controls fuel flow regulation device 40 to prevent fuel 12 from entering combustion zone 18 through third passageway 238, controls main air flow regulation device to inject air 30 into combustion zone 18 through first passageway 224 and/or second passageway 230 at first velocity $V_1$, and controls air flow regulation device 42 and air velocity control device 44 to inject air 30 into combustion zone 18 through center passageway 236 at second velocity $V_2$, which is higher than velocity $V_1$. As such, the first portion 202 of air 30 is injected at velocity $V_1$ and the second portion 204 of air 30 is injected at velocity $V_2$. In another embodiment, air 30 entering through center passageway 236 does not experience a velocity change through air velocity control device 44, and air 30 entering combustion zone 18 through center, first, and/or second passageways 236, 224, and/or 230, respectively, enters from air flow regulation device 42 and main air regulation device 62 at substantially the same velocity.

Figure 3:
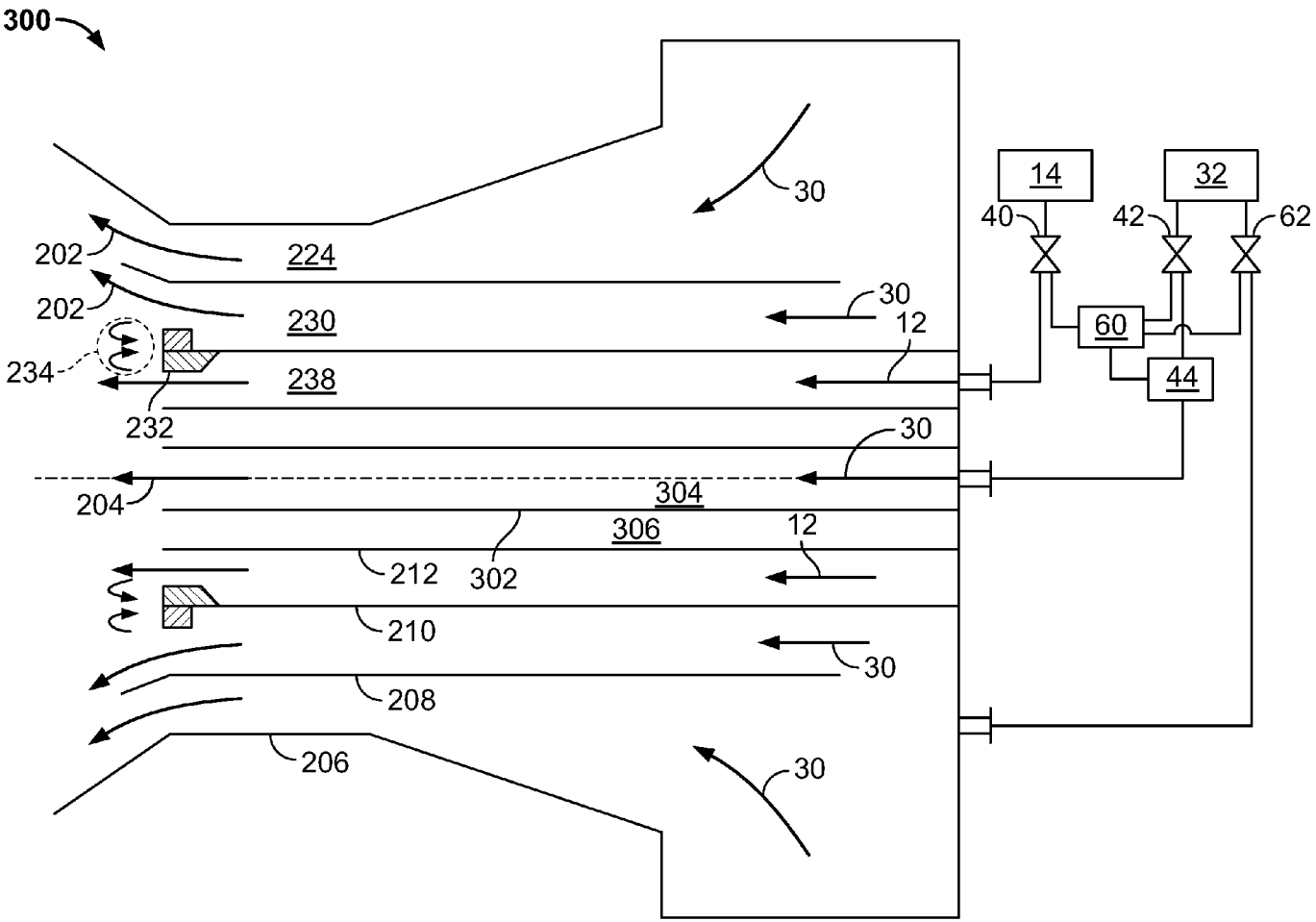
FIG. 3 is a schematic view of an alternative burner that may be used with the power plant system shown in FIG. 1.

FIG. 3 is a schematic view of an alternative exemplary multi-function burner 300 that may be used as burner 100 within system 10. Burner 300 is substantially similar to burner 200, as described above, with the exception that burner 300 includes a fifth duct 302 that is substantially concentrically aligned with and is spaced radially inward from fourth duct 212. More specifically, in the exemplary embodiment, fifth duct 302 is substantially cylindrical and defines a center passageway 304 having a diameter $D_2$ that is smaller than diameter $D_1$ (shown in FIG. 2). Alternatively, diameter $D_2$ may be substantially equal to, or larger than, diameter $D_1$. Fifth duct 302 is spaced radially imward from fourth duct 212 such that a fourth passageway 306 is defined between fourth and fifth ducts 212 and 302. In the exemplary embodiment, fifth duct 302 is coupled in flow communication with air source 32 via air flow regulation device 42 and air velocity control device 44. As such, fifth duct 302 is oriented such that air 30 may be injected through center passageway 304 into intermediate air zone 46 (shown in FIG. 1) at a predetermined velocity, when burner 300 is used to inject air 30.

During the first or second operation of burner 300, control system 60 controls air flow regulation device 42 and air velocity control device 44 to either prevent, or to enable air 30 to be injected into combustion zone 18 through center passageway 304 at second velocity $V_2$, as described above. Accordingly, only an insignificant amount of air 30 is injected through fourth passageway 306, during either operation of multi-function burner 300.

The above-described methods and apparatuses facilitate increasing the effectiveness and flexibility of staging air and/or fuel within a furnace, as compared to furnaces that do not include multi-function burners. More specifically, the multi-function burners described herein facilitate providing low-NOx burner performance and/or providing optimal air injection that increases the effective air/gas mixing upstream of the reburn zone as compared to furnaces that do not include multi-function burners. As such, the above-described burners facilitate increasing the operational flexibility of the furnace and optimizing intermediate stage air/gas mixing in a multi-stage reburn application.

Furthermore, the above-described burners facilitate reducing burnout residence time requirements, while improving gas emissions control, as compared to a single-function burner operating in a cooling mode. For example, NOx control is facilitated to be improved, as compared to a single-function burner operating in a cooling mode, by enabling both near and far field air/gas mixing when the above-described burner is operating in an air-injection mode. More specifically, the higher velocity air injected through the multi-function burner penetrates the far-field within the furnace to facilitate substantially homogenous mixing among air, fuel, and combustion gases before the mixture of gases enters subsequence staging zones. By more efficiently reducing the variance in the gas stoichiometric ratio flowing into the reburn zone, the above-described burner facilitates reducing burnout residence time requirements and reducing NOx, carbon-in-ash, and CO, as compared to furnaces that do not include multi-function burners.

Moreover, by utilizing the above-described fifth duct, the diameter of a center passageway of a burner may be reduced to facilitate reducing the amount of air required to achieve a suitably high air velocity for far-field penetration, as compared to burners having a larger center passageway diameter. As such, retrofitting a furnace with the above-described multi-function burners is facilitated to be simplified. Furthermore, the above-described burner includes a passageway for swirled or non-swirled lower velocity air, which facilitates cooling the burner and penetrating the near-field of the furnace.

Exemplary embodiments of a method and apparatus for combusting fuel and air within a combustion device are described above in detail. The method and apparatus are not limited to the specific embodiments described herein, but rather, components of the method and apparatus may be utilized independently and separately from other components described herein. For example, the multi-function burner may also be used in combination with other emission control systems and methods, and is not limited to practice with only the fuel-fired power plant as described herein. Rather, the present invention can be implemented and utilized in connection with many other staged fuel and air combustion applications.

While the invention has been described in terms of various specific embodiments, those skilled in the art will recognize that the invention can be practiced with modification within the spirit and scope of the claims.

What is claimed is:

1. A method for operating a fuel-fired furnace including at least one burner, said method comprising:

mixing a far field and a near field substantially homogeneously by:

channeling a first air flow to the at least one burner at a first predetermined velocity;

channeling a second air flow to the at least one burner at a second predetermined velocity during a first mode of operation of the at least one burner, wherein the second predetermined velocity is different than the first predetermined velocity, and wherein during the first mode of operation, fuel is substantially prevented from being channeled through the at least one burner; and creating a recirculation zone by channeling a fuel flow through a flame regulation device to the at least one burner during a second mode of operation, wherein during the second mode of operation, the second air flow is substantially prevented from being channeled through the at least one burner.

2. A method in accordance with claim 1 wherein:

channeling a second air flow to the at least one burner further comprises channeling the second air flow through a first duct; and channeling a fuel flow to the at least one burner further comprises channeling the fuel flow through a second duct that is substantially concentrically-aligned with and radially outward from the first duct.

3. A method in accordance with claim 1 wherein:

channeling a first air flow to the at least one burner further comprises channeling the first air flow through a first passageway defined through the at least one burner; and channeling a second air flow to the at least one burner further comprises channeling the second air flow through a second passageway defined through the at least one burner.

4. A method in accordance with claim 3 wherein channeling the first air flow through a first passageway and channeling the second air flow through a second passageway further comprises channeling the first and second air flows through substantially concentrically-aligned first and second passageways.

5. A method in accordance with claim 1 wherein channeling a first air flow to the at least one burner further comprises channeling the first air flow to a burner at a downstream end of a combustion zone within the fuel-fired furnace.

6. A burner for use with a fuel-fired furnace, said burner comprising:

a first duct configured to channel a fuel flow into the furnace, said first duct comprises a flame regulation device coupled to a downstream end of said first duct;

a second duct substantially concentrically-aligned with and extending through said first duct, said second duct configured to channel a first air flow into the furnace, at a first predetermined velocity when the fuel flow is substantially prevented from flowing into the furnace through said first duct; and at least one third duct substantially concentrically-aligned with said first duct, said at least one third duct radially outward from said first duct and configured to channel a second air flow into the furnace at a second predetermined velocity that is different than the first predetermined velocity, wherein the first and second air flows facilitate substantially homogeneous mixing of a far field and a near field.

7. A burner in accordance with claim 6 wherein the fuel flow is a flow of air including fuel particulates entrained therein.

8. A burner in accordance with claim 6 wherein the second predetermined velocity is slower than the first predetermined velocity.

9. A burner in accordance with claim 6 further comprising an annular wall extending circumferentially between said first duct and said third duct.

10. A burner in accordance with claim 6 further comprising a fourth duct coupled between said second duct and said first duct.

11. A fuel-fired furnace coupled to a fuel source and an air source, said furnace comprising:

a combustion zone defined within said furnace;

a first flow regulation device coupled to the fuel source and selectively operable based on an operation of said furnace;

a second flow regulation device coupled to the air source and selectively operable based on an operation of said furnace; and a plurality of burners coupled within said combustion zone, at least one of said plurality of burners comprising:

a first duct coupled to the fuel source via said first flow regulation device, said first duct comprises a flame regulation device coupled to a downstream end of said first duct, said first duct configured to channel a fuel flow into said furnace;

a second duct extending through said first duct, said second duct coupled to the air source via said second flow regulation device and configured to channel a first air flow into said furnace at a first predetermined velocity when the fuel flow is substantially prevented from being channeled through said first duct by said first flow regulation device;

a third flow regulation device coupled to the air source and selectively operable based on an operation of said furnace; and at least one third duct substantially concentrically-aligned with and radially outward from said first duct, said at least one third duct coupled to the air source via said third flow regulation device and configured to channel a second air flow into said furnace at a second predetermined velocity that is different than the first predetermined velocity, wherein the first and second air flows facilitate substantially homogeneous mixing of a far field and a near field.

12. A fuel-fired furnace in accordance with claim 11 further comprises a fuel injector coupled downstream from said combustion zone.

13. A fuel-fired furnace in accordance with claim 11 further comprising an air injector coupled downstream from said combustion zone.

14. A fuel-fired furnace in accordance with claim 11 further comprising a velocity regulation device coupled in flow communication with said second duct and the air source.

15. A fuel-fired furnace in accordance with claim 11 wherein said at least one burner further comprises a fourth duct coupled between said second duct and said first duct.

16. A fuel-fired furnace in accordance with claim 11 further comprising a control system operatively coupled to said first flow regulation device, said second flow regulation device, said third flow regulation device, said control system configured to:

channel the second air flow to said third duct at the second predetermined velocity;

channel the first air flow to said second duct at the second predetermined velocity during a first mode of operation of said furnace, the first mode of operation substantially preventing the fuel flow from being channeled through said first duct;

discontinue the first air flow to said second duct during a second mode of operation of said furnace; and channel the fuel flow to said first duct during the second mode of operation, the second mode of operation substantially preventing the first air flow from being channeled through said second duct.

* * * * *